US011511905B2

(12) United States Patent
Al-Housseiny

(10) Patent No.: US 11,511,905 B2
(45) Date of Patent: Nov. 29, 2022

(54) BLANK USED FOR MAKING A CONTAINER WITH INTERLOCKING FLAPS AND A HANDLE

(71) Applicant: Talal T. Al-Housseiny, Princeton, NJ (US)

(72) Inventor: Talal T. Al-Housseiny, Princeton, NJ (US)

( * ) Notice: Subject to any disclaimer, the term of this patent is extended or adjusted under 35 U.S.C. 154(b) by 295 days.

(21) Appl. No.: 16/894,311

(22) Filed: Jun. 5, 2020

(65) Prior Publication Data

US 2021/0245915 A1 Aug. 12, 2021

Related U.S. Application Data

(60) Provisional application No. 62/975,581, filed on Feb. 12, 2020.

(51) Int. Cl.

| | |
|---|---|
| ***B65D 5/46*** | (2006.01) |
| ***B65D 5/10*** | (2006.01) |
| *B65D 5/02* | (2006.01) |

(52) U.S. Cl.

CPC ..... *B65D 5/10* (2013.01); *B65D 5/46096* (2013.01); *B65D 5/029* (2013.01)

(58) Field of Classification Search

CPC .... B65D 5/46088–46112; B65D 5/029; B65D 77/065; B65D 77/068; B65D 5/476; B65D 5/2047; B65D 5/4208; B65D 5/10; B67D 2001/0827

USPC ..... 229/117.13–117.14; 220/465.03; 222/105

See application file for complete search history.

(56) References Cited

U.S. PATENT DOCUMENTS

| | | | |
|---|---|---|---|
| 1,810,743 | A | 6/1931 | Allen |
| 1,852,527 | A | 4/1932 | King |
| 2,323,782 | A | 7/1943 | Kretchmer |
| 2,675,168 | A | 4/1954 | Clark |
| 2,713,965 | A | 7/1955 | Acker |
| 2,838,222 | A | 6/1958 | Papadopoulos |

(Continued)

FOREIGN PATENT DOCUMENTS

| | | | |
|---|---|---|---|
| CN | 104787423 | A * | 7/2015 |
| DE | 3641485 | A1 * | 6/1988 |

(Continued)

*Primary Examiner* — Nathan J Newhouse
*Assistant Examiner* — Phillip D Schmidt
(74) *Attorney, Agent, or Firm* — Meagher Emanuel Laks Goldberg & Laio, LLP

(57) ABSTRACT

A blank used for making a container is disclosed. The blank comprises a first primary panel, a second primary panel, and a secondary panel. The first primary panel is hingedly coupled to a first primary flap. The second primary panel is hingedly coupled to a second primary flap. The secondary panel is hingedly coupled to a secondary flap. The first primary flap comprises a main portion and a tip portion. The main portion is hingedly coupled to a first handle. The tip portion is positioned between the main portion and the first handle. The secondary flap is configured to be positioned between the second primary flap and the main portion when the container is in a box configuration. The tip portion is configured to be positioned between the second primary flap and an interior space of the container when the container is in the box configuration.

11 Claims, 8 Drawing Sheets

(56) References Cited

U.S. PATENT DOCUMENTS

| | | | | | |
|---|---|---|---|---|---|
| 2,903,180 | A | * | 9/1959 | Holmes | B65D 5/542 229/209 |
| 3,539,090 | A | | 11/1970 | Blasdell | |
| 4,017,019 | A | | 4/1977 | Booth | |
| 4,214,697 | A | * | 7/1980 | Manning | B65D 5/067 229/184 |
| 4,238,068 | A | * | 12/1980 | Ellerbe | B65D 5/106 229/101 |
| 4,279,379 | A | | 7/1981 | Lohrbach | |
| 4,308,995 | A | * | 1/1982 | Hanes | B65D 5/46096 229/117.22 |
| 4,403,728 | A | | 9/1983 | Koltz | |
| 4,415,117 | A | | 11/1983 | Pollard | |
| 4,530,459 | A | * | 7/1985 | Maroszek | B65D 77/042 229/120.32 |
| 4,830,270 | A | | 5/1989 | Holmes | |
| 5,423,478 | A | * | 6/1995 | Roosa | B65D 5/46104 229/117.14 |
| 6,378,733 | B1 | * | 4/2002 | Boonzaier | B65D 77/065 229/117.14 |
| 7,571,835 | B2 | | 8/2009 | Hill | |
| 7,669,753 | B2 | | 3/2010 | West | |
| 2006/0163333 | A1 | | 7/2006 | Komacki | |
| 2006/0202020 | A1 | | 9/2006 | VanKirk | |

FOREIGN PATENT DOCUMENTS

| | | | | |
|---|---|---|---|---|
| EP | 0533457 | A1 | * | 9/1992 |
| FR | 2342209 | A1 | | 3/2007 |

* cited by examiner

200a

200b

200c

200d

200e

200f

BLANK USED FOR MAKING A CONTAINER WITH INTERLOCKING FLAPS AND A HANDLE

CROSS-REFERENCE TO RELATED APPLICATIONS

This application claims the benefit of U.S. Provisional Patent Application No. 62/975,581, filed on Feb. 12, 2020, which is incorporated in its entirety herein.

FIELD OF THE INVENTION

Embodiments are in the field of containers. More particularly, embodiments disclosed herein relate to blanks used for making containers which, inter alia, foster a container with interlocking flaps and a handle. The container can be rapidly, easily, and conveniently formed. The container provides convenience while reducing material costs and manufacturing costs.

BACKGROUND OF THE INVENTION

There are several challenges that are associated with packaging food, beverages, consumer products, etc. For example, containers may be required to be held for a variety of purposes such as carrying, lifting, pouring, serving, using, delivering, catering, storing, moving, transporting, etc. In addition, these containers may be required to be formed quickly and conveniently.

To address the previous challenges, a number of packaging solutions have been proposed. These packaging solutions (e.g., handles, locking inserts, extended flaps, etc.) use significantly more material than typical containers. As a result, cost effectiveness may be compromised. In addition, these packaging solutions may not provide a convenient box forming experience.

Thus, it is desirable to provide a blank for making a container that is able to overcome the above disadvantages.

Advantages of the present invention will become more fully apparent from the detailed description of the invention hereinbelow.

SUMMARY OF THE INVENTION

Embodiments of the present disclosure are drawn to a blank or a container, where the blank or container comprises two primary panels, interlocking flaps, and a handle.

A first aspect of the present disclosure is drawn to embodiments directed to a blank used for making a container. The blank comprises a first primary panel, a second primary panel, and a secondary panel. The first primary panel is hingedly coupled to a first primary flap. The second primary panel is hingedly coupled to a second primary flap. The secondary panel is hingedly coupled to a secondary flap. The first primary flap comprises a main portion and a tip portion. The main portion is hingedly coupled to a first handle. The tip portion is positioned between the main portion and the first handle. The first primary panel and the second primary panel are configured to face each other when the container is in a box configuration. The secondary flap is configured to be positioned between the second primary flap and the main portion when the container is in the box configuration. The tip portion is configured to be positioned between the second primary flap and an interior space of the container when the container is in the box configuration. The first handle is configured to fold towards the main portion. The container is configured to be held via the first handle when the container is in the box configuration.

A second aspect of the present disclosure is drawn to embodiments directed to a container. The container comprises a first primary panel, a second primary panel, and a secondary panel. The first primary panel is hingedly coupled to a first primary flap. The second primary panel is hingedly coupled to a second primary flap. The secondary panel is hingedly coupled to a secondary flap. The first primary flap comprises a main portion and a tip portion. The main portion is hingedly coupled to a first handle. The tip portion is positioned between the main portion and the first handle when the container is in a flat configuration. The first primary panel and the second primary panel are configured to face each other when the container is in a box configuration. The secondary flap is configured to be positioned between the second primary flap and the main portion when the container is in the box configuration. The tip portion is configured to be positioned between the second primary flap and an interior space of the container when the container is in the box configuration. The first handle is configured to fold towards the main portion. The container is configured to be held via the first handle when the container is in the box configuration.

A third aspect of the present disclosure is drawn to embodiments directed to a blank used for making a container. The blank comprises a first primary panel, a second primary panel, and a secondary panel. The first primary panel is hingedly coupled to a first primary flap. The second primary panel is hingedly coupled to a second primary flap. The secondary panel is hingedly coupled to a secondary flap. The first primary flap comprises a main portion and a tip portion. The second primary flap is hingedly coupled to a second handle. The first primary panel and the second primary panel are configured to face each other when the container is in a box configuration. The secondary flap is configured to be positioned between the second primary flap and the main portion when the container is in the box configuration. The tip portion is configured to be positioned between the second primary flap and an interior space of the container when the container is in the box configuration. The second handle is configured to fold towards the second primary flap. The container is configured to be held via the second handle when the container is in the box configuration.

A fourth aspect of the present disclosure is drawn to embodiments directed to a container. The container comprises a first primary panel, a second primary panel, and a secondary panel. The first primary panel is hingedly coupled to a first primary flap. The second primary panel is hingedly coupled to a second primary flap. The secondary panel is hingedly coupled to a secondary flap. The first primary flap comprises a main portion and a tip portion. The second primary flap is hingedly coupled to a second handle. The first primary panel and the second primary panel are configured to face each other when the container is in a box configuration. The secondary flap is configured to be positioned between the second primary flap and the main portion when the container is in the box configuration. The tip portion is configured to be positioned between the second primary flap and an interior space of the container when the container is in the box configuration. The second handle is configured to fold towards the second primary flap. The container is configured to be held via the second handle when the container is in the box configuration.

Additional embodiments and additional features of embodiments for the blanks used for making containers are described below and are hereby incorporated into this section.

BRIEF DESCRIPTION OF THE DRAWINGS

The detailed description will refer to the following drawings, wherein like reference numerals refer to like elements, and wherein.

DETAILED DESCRIPTION OF THE INVENTION

Figure 1A:
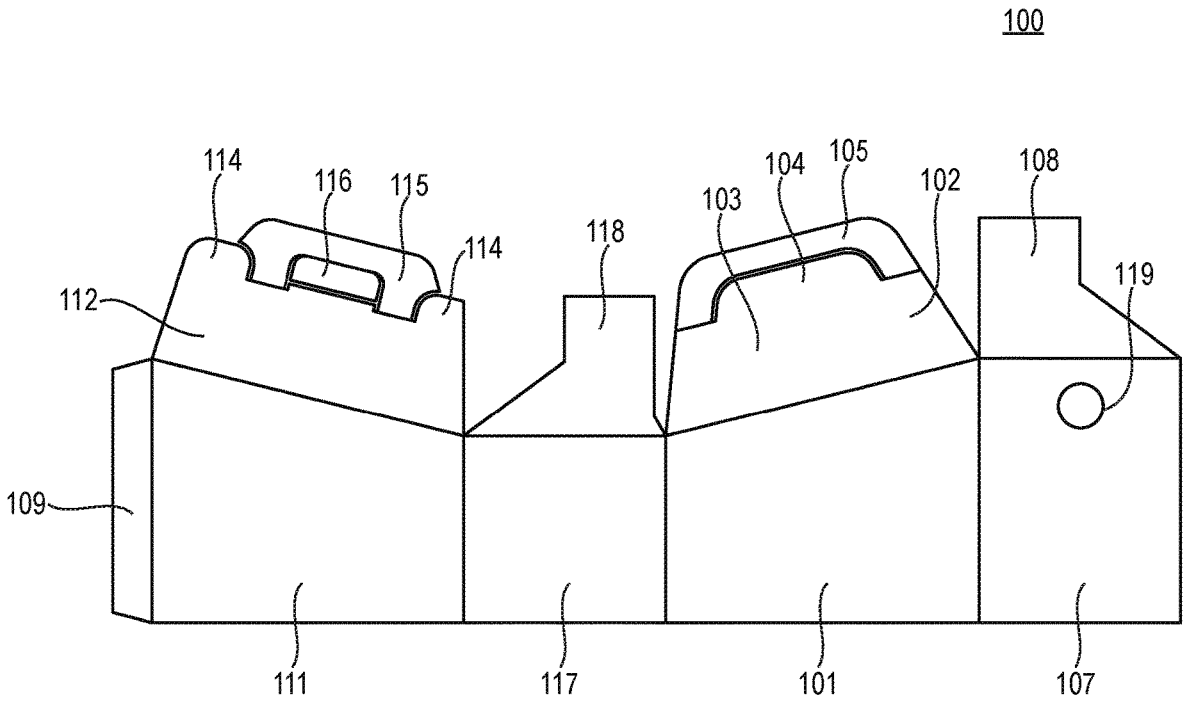
FIG. 1A is a diagram illustrating a plan view of an embodiment of a blank used for making a container. The blank comprises a first primary panel, a second primary panel, and a secondary panel. The first primary panel is hingedly coupled to a first primary flap. The second primary panel is hingedly coupled to a second primary flap. The secondary panel is hingedly coupled to a secondary flap. The first primary flap comprises a main portion and a tip portion. The main portion is hingedly coupled to a first handle. The tip portion is positioned between the main portion and the first handle. The blank also comprises a glue flap.

It is to be understood that the figures and descriptions of the present invention may have been simplified to illustrate elements that are relevant for a clear understanding of the present invention, while eliminating, for purposes of clarity, other elements found in a typical container or typical method of using a container. Those of ordinary skill in the art will recognize that other elements may be desirable and/or required in order to implement the present invention. However, because such elements are well known in the art, and because they do not facilitate a better understanding of the present invention, a discussion of such elements is not provided herein. It is also to be understood that the drawings included herewith only provide diagrammatic representations of the presently preferred structures of the present invention and that structures falling within the scope of the present invention may include structures different than those shown in the drawings. Reference will now be made to the drawings wherein like structures are provided with like reference designations.

For purposes of this disclosure, the term "planar" refers to an element or combination of elements that may have any thickness, and having sides defining the thickness that are parallel with each other.

For purposes of this disclosure, the expression "A is hingedly coupled to B" refers to an element A being movably coupled to an element B via a hinge. A hinge may comprise a perforation, a crease, a score, a bend, a section with less thickness than surrounding material, a section with less density than surrounding material, and a combination thereof.

For purposes of this disclosure, the expression "A is configured to fold towards B" refers to at least a portion of element A being configured to fold towards at least a portion of element B via a hinge.

For purposes of this disclosure, an "interior space of the container" refers to a space that is enclosed by the container and that may contain content of the container, when the container is in a box configuration.

Embodiments are directed to a blank used for making a container. Embodiments are also directed to a container. The container may be used for packaging various products (e.g., food, beverages, consumer products, etc.), for shipping (e.g., moving, transfers, deliveries, catering, etc.), and for storage (e.g., food, beverages, consumer products, etc.), or other suitable uses. The uses of the container are abundant. The spectrum of users may include manufacturers, restaurants, retailers, stores, distributors (e.g., fulfillment centers, warehouses, storage facilities, etc.), end-customers, and consumers. For example, as a bag-in-box application, the container may have an inner bag with a spout to cater, deliver, serve, and/or pour liquids (e.g. beverages).

The composition of the blank may vary. Portions or all of the blank may comprise a suitable flexible material that allows for folding, collapsing, and moving such as cardboard, paperboard, paper, corrugated carton, plastic, corrugated plastic, polymers, metal, or combinations thereof. In addition, the blank may comprise a plurality of different suitable materials. The material of any portion of the blank may be chosen for reusability of the container, or, alternatively, the material may be chosen based on a disposable (i.e., a one-time or limited use) variation.

The size, dimensions, thickness, shape, and weight of the blank or portions of the blank may vary. Portions or all of the blank may be configured based on the desired overall features of the container and/or content to be contained within the container. Hence, the size, dimensions, thickness, shape and weight of portions or all of the blank may vary. Moreover, the position, the length and the orientation of the various hinges may be configured based on the desired overall features of the container.

The manufacturing of the blank may vary. Desired objectives for the manufacturing processes may include reducing material costs, reducing manufacturing costs, reducing material waste, reducing manufacturing complexity, reducing shipping costs, or a combination thereof. The blank may be a single sheet of material or may be assembled by coupling (e.g., connecting or attaching) various portions of a plurality of independent sheets of material. Furthermore, portions or all of the blank may comprise more than one layer of material. For example, multiple layers of material may be attached or glued to each other.

The manufacturing of the container may vary. Desired objectives for the manufacturing processes may include reducing material costs, reducing manufacturing costs, reducing material waste, reducing manufacturing complexity, reducing shipping costs, or a combination thereof. The container may be made from a single sheet of material or may be assembled by coupling (e.g., connecting or attaching) various portions of a plurality of independent sheets of material.

FIG. 1A is a diagram illustrating a plan view of an embodiment of a blank 100 used for making a container. The blank 100 comprises a first primary panel 101, a second primary panel 111, and a secondary panel 107, 117. The first primary panel 101 is hingedly coupled to a first primary flap 102. The second primary panel 111 is hingedly coupled to a second primary flap 112. The secondary panel 107, 117 is hingedly coupled to a secondary flap 108, 118. The first primary flap 102 comprises a main portion 103 and a tip portion 104. The main portion 103 is hingedly coupled to a first handle 105. The tip portion 104 is positioned between the main portion 103 and the first handle 105. The blank 100 also comprises a glue flap 109. Although the blank 100 shown in FIG. 1A does not depict bottom flaps, one of skill in the art will recognize that any suitable bottom features, design, and/or style may be added (see FIGS. 2A-2F for example). Preferably, a bottom flap would be hingedly coupled to at least one of the first primary panel 101, the second primary panel 111, and/or the secondary panel 107, 117.

Figure 1B:
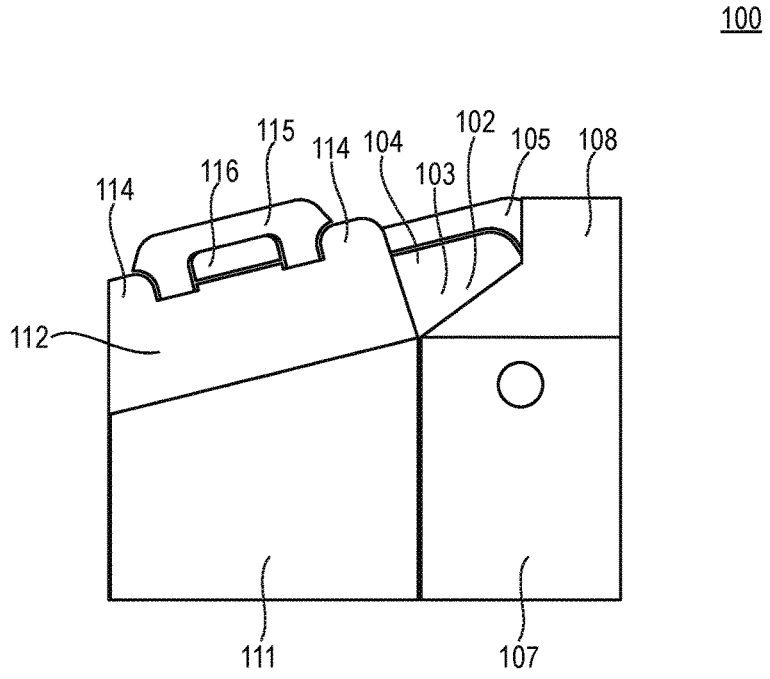
FIG. 1B is a diagram illustrating a plan view of a flat configuration of the container made from the blank shown in FIG. 1A.

FIG. 1B is a diagram illustrating a plan view of a flat configuration of the container made from the blank 100 shown in FIG. 1A.

Figure 1C:
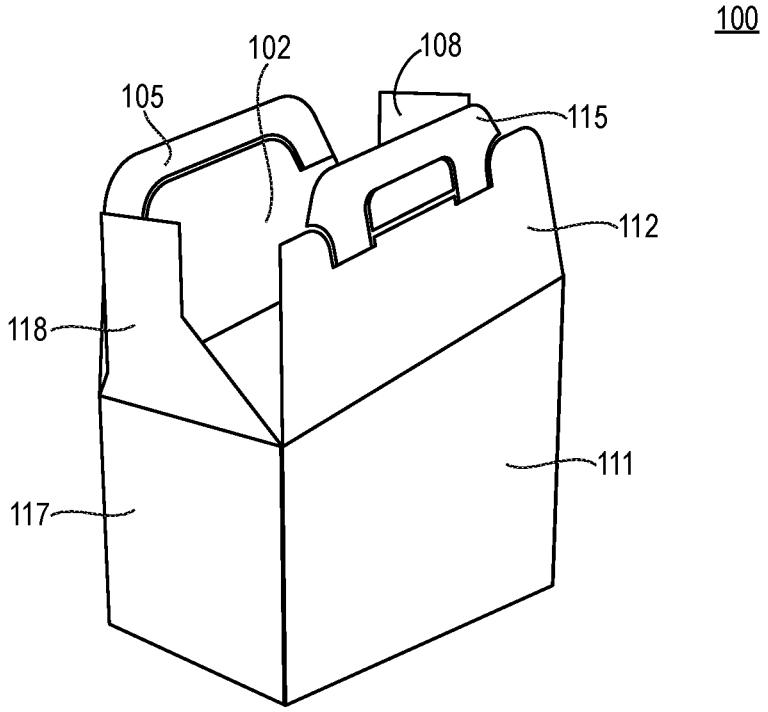
FIG. 1C is a diagram illustrating a perspective view of a box configuration of the container made from the blank shown in FIG. 1A.

FIG. 1C is a diagram illustrating a perspective view of a box configuration of the container made from the blank 100 shown in FIG. 1A.

Figure 1D:
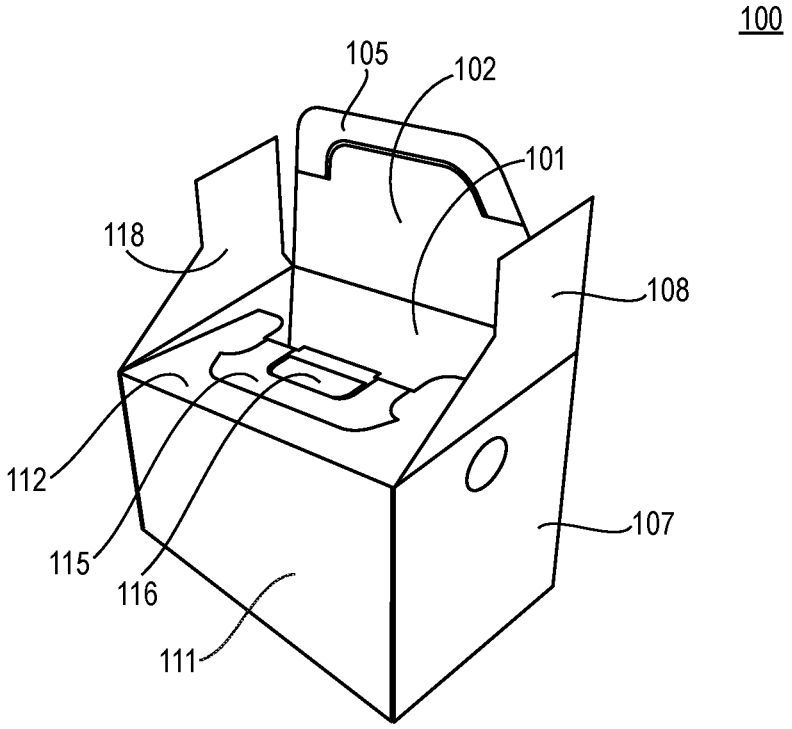
FIGS. 1D-1G is a sequence illustrating perspective views of the box configuration of the container made from the blank shown in FIG. 1A, wherein the second primary flap is folded (FIG. 1D), wherein the secondary flap is folded (FIG. 1E), wherein the first primary flap and the first handle are folded (FIG. 1F), and wherein the tip portion is inserted in an aperture provided by the second primary flap and the secondary flap (FIG. 1G).
Figure 1E:
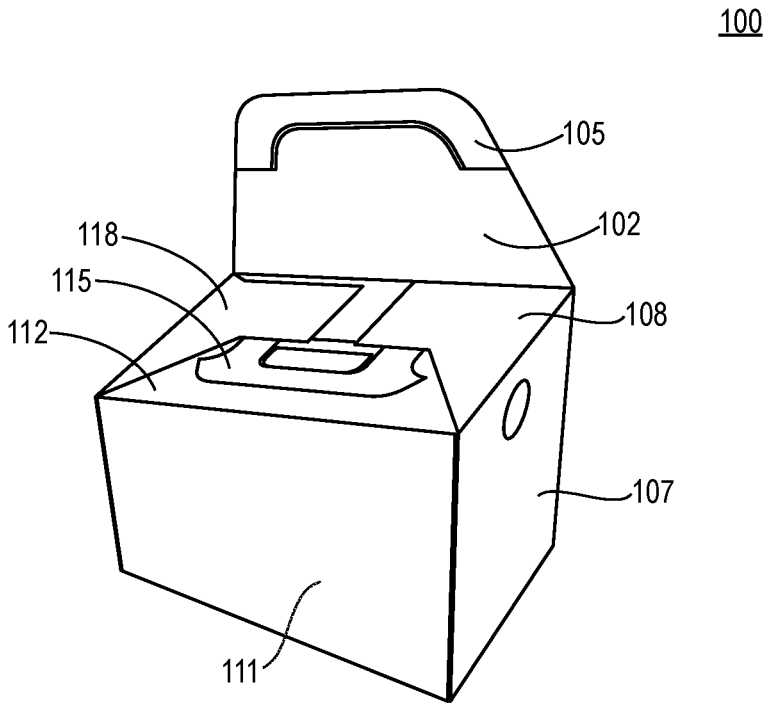
Figure 1F:
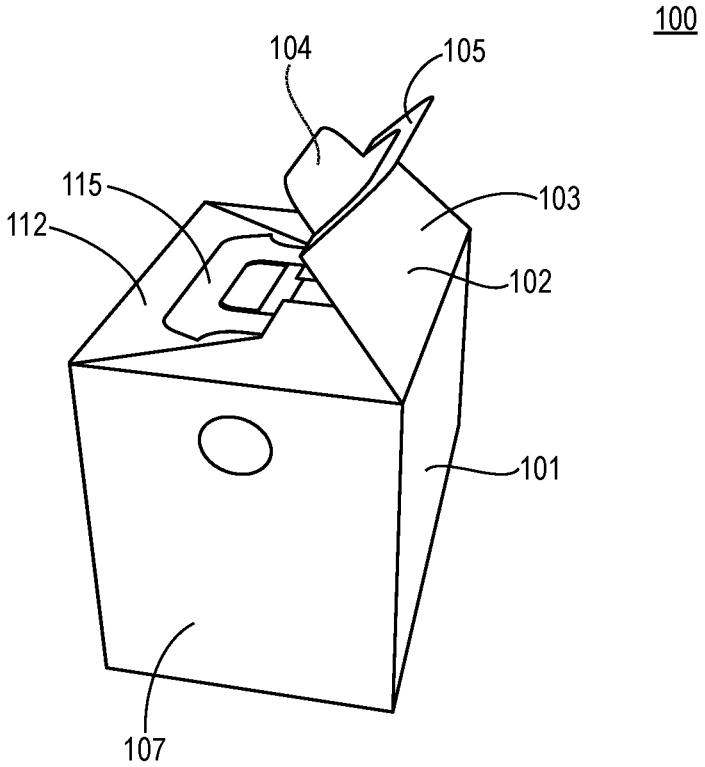
Figure 1G:
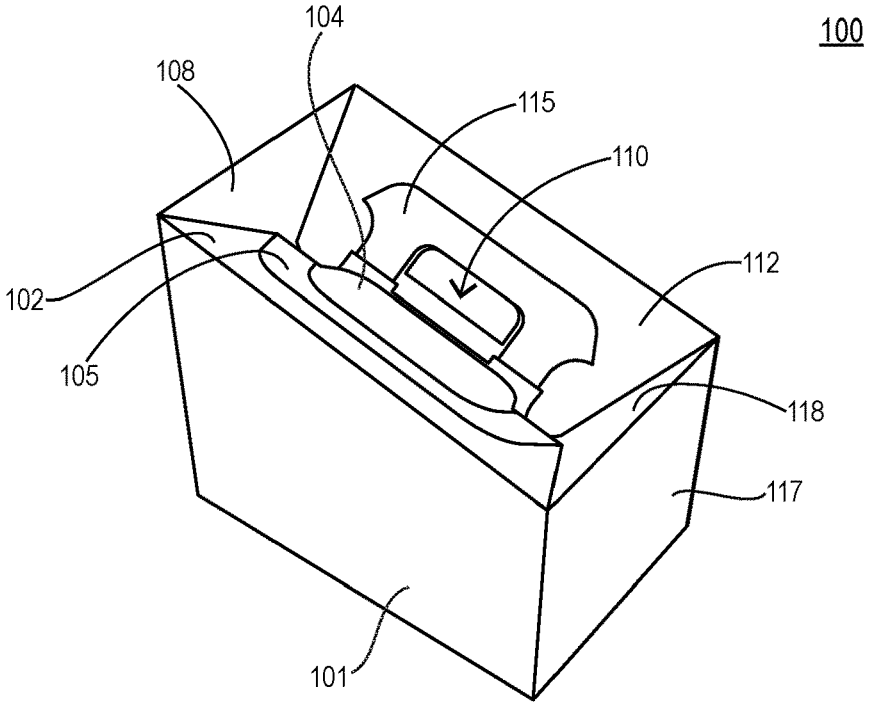

FIGS. 1D-1G is a sequence illustrating perspective views of the box configuration of the container made from the blank 100 shown in FIG. 1A, wherein the second primary flap 112 is folded (FIG. 1D), wherein the secondary flap 108, 118 is folded (FIG. 1E), wherein the first primary flap 102 and the first handle 105 are folded (FIG. 1F), and wherein the tip portion 104 is inserted in an aperture 110 provided by the second primary flap 112 and the secondary flap 108, 118 (FIG. 1G).

Figure 1H:
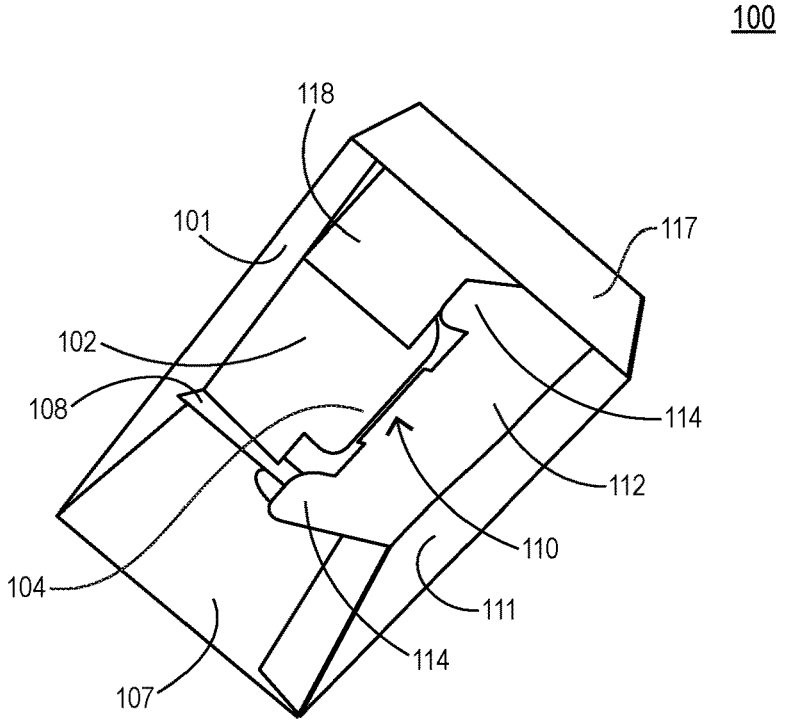
FIG. 1H is a diagram illustrating another perspective view of FIG. 1G.

FIG. 1H is a diagram illustrating another perspective view of FIG. 1G.

Figure 1I:
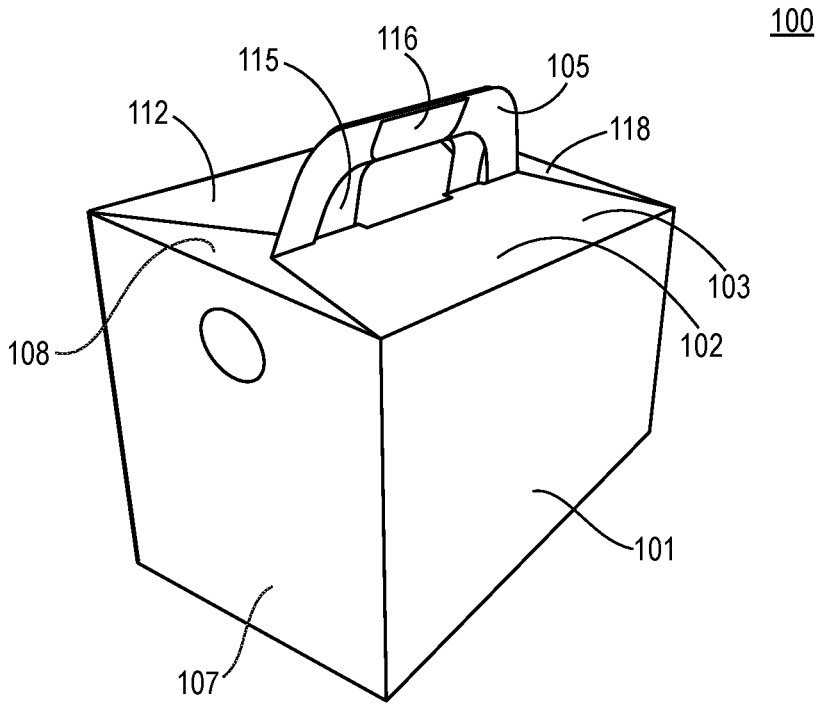
FIG. 1I is a diagram illustrating a perspective view of the box configuration of the container made from the blank shown in FIG. 1A, wherein the secondary flap is positioned between the second primary flap and the main portion, wherein the tip portion (not visible) is positioned between the second primary flap and an interior space of the container, and wherein the container is configured to be held via the first handle.

FIG. 1I is a diagram illustrating a perspective view of the box configuration of the container made from the blank 100 shown in FIG. 1A, wherein the secondary flap 108, 118 is positioned between the second primary flap 112 and the main portion 103, wherein the tip portion 104 (not visible) is positioned between the second primary flap 112 and an interior space of the container, and wherein the container is configured to be held via the first handle 105. The container is typically held by a human hand that substantially encompasses the first handle 105.

Figure 1J:
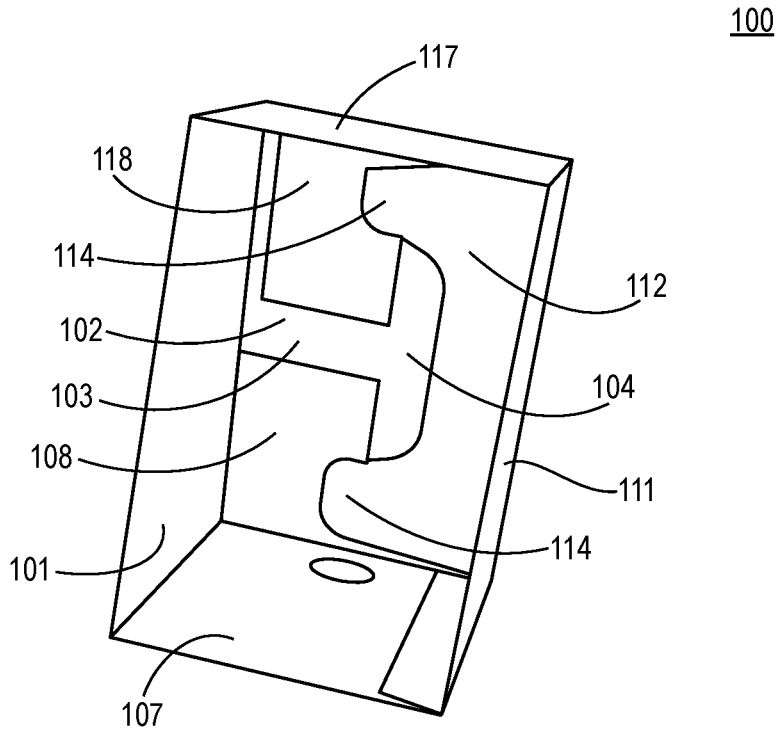
FIG. 1J is a diagram illustrating another perspective view of FIG. 1I.

FIG. 1J is a diagram illustrating another perspective view of FIG. 1I.

Figure 2A:
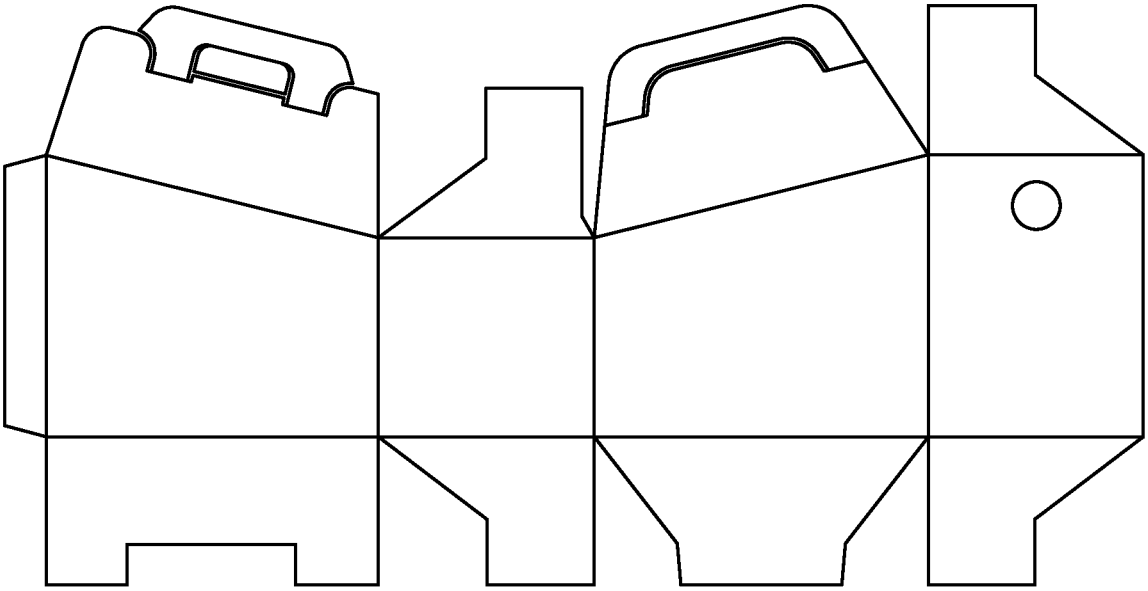
FIGS. 2A-2F are diagrams illustrating plan views of embodiments of blanks used for making containers. The blanks shown in FIGS. 2A-2F are alternative configurations to the blank shown in FIG. 1A.
Figure 2B:
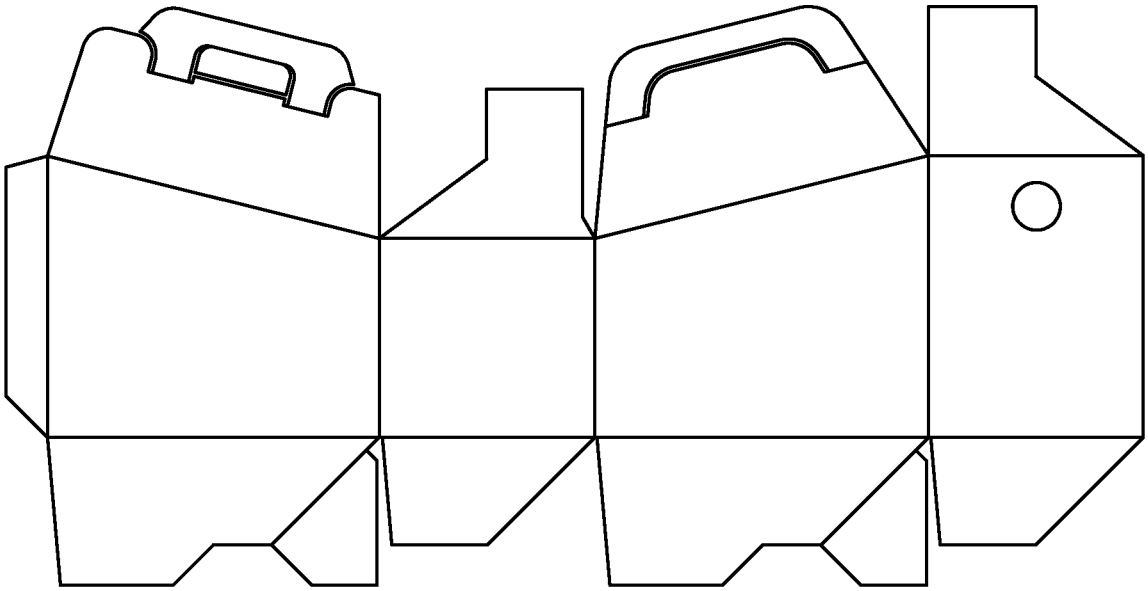
Figure 2C:
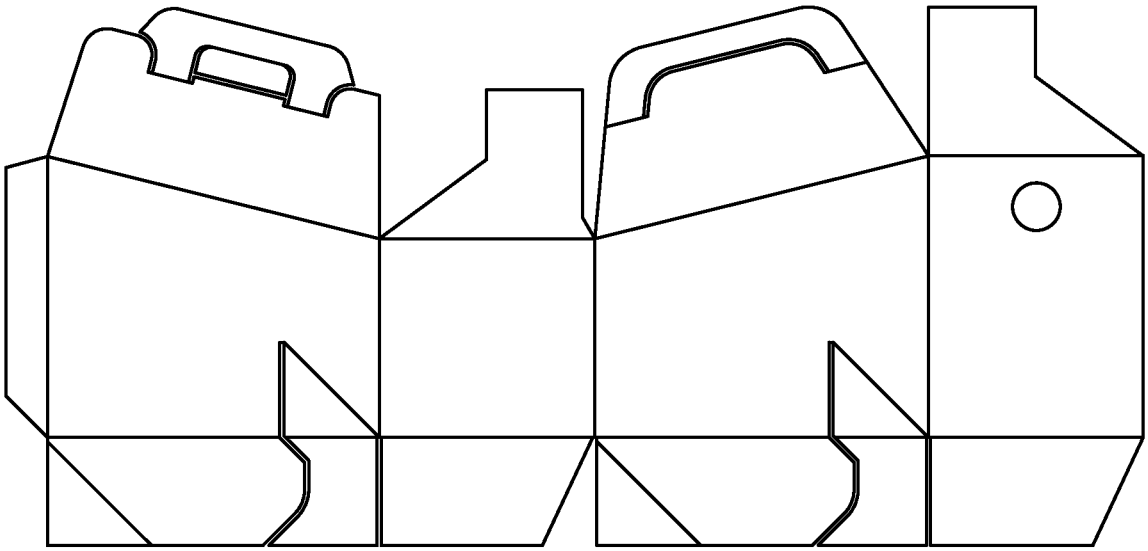
Figure 2D:
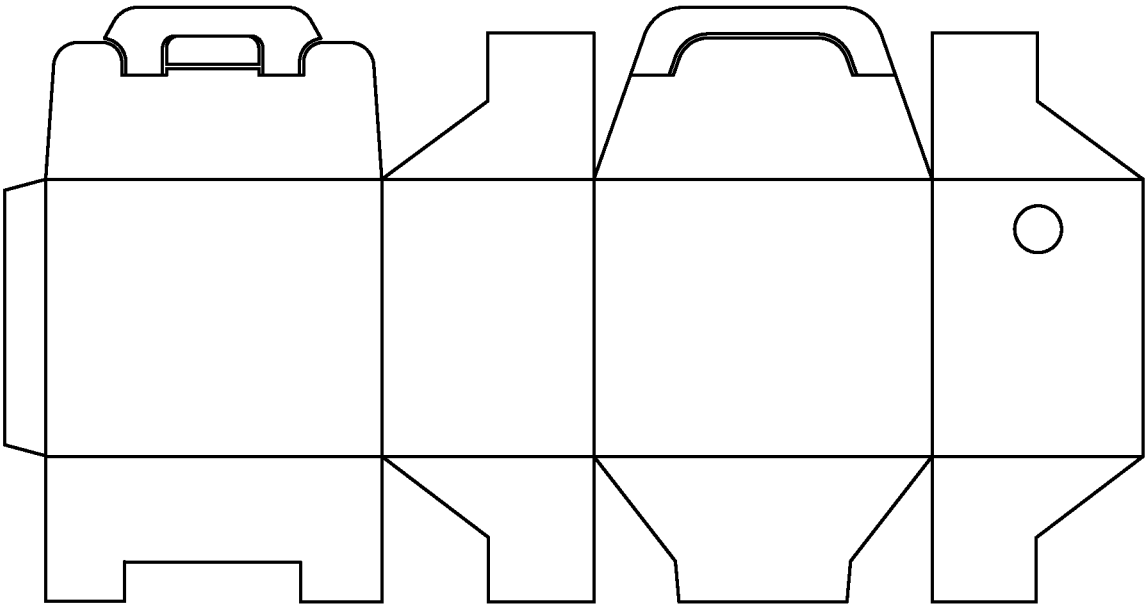
Figure 2E:
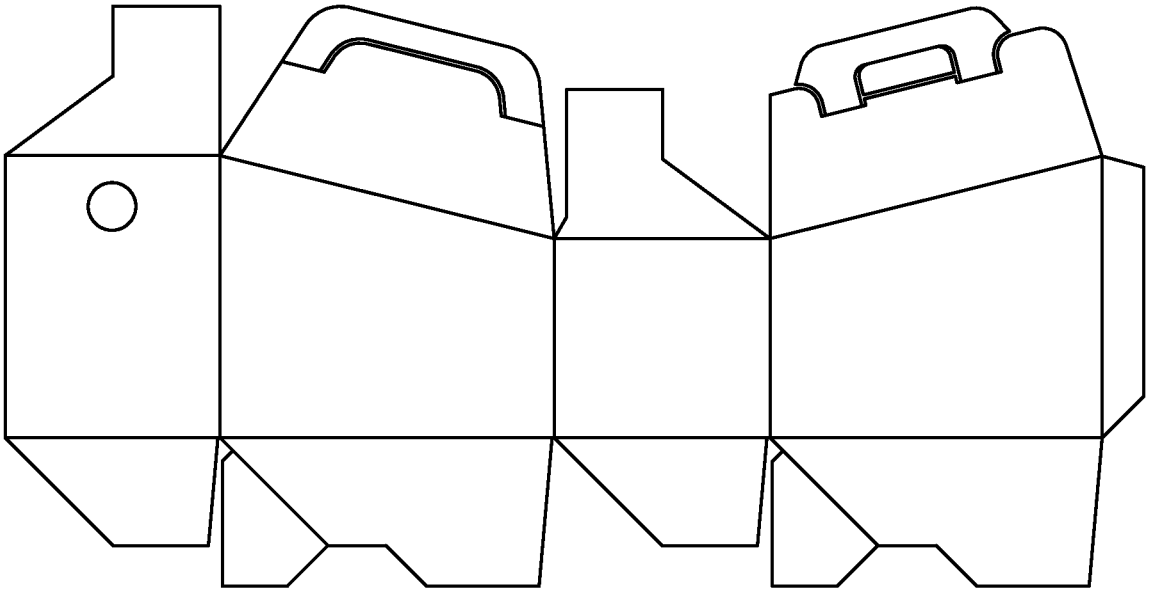
Figure 2F:
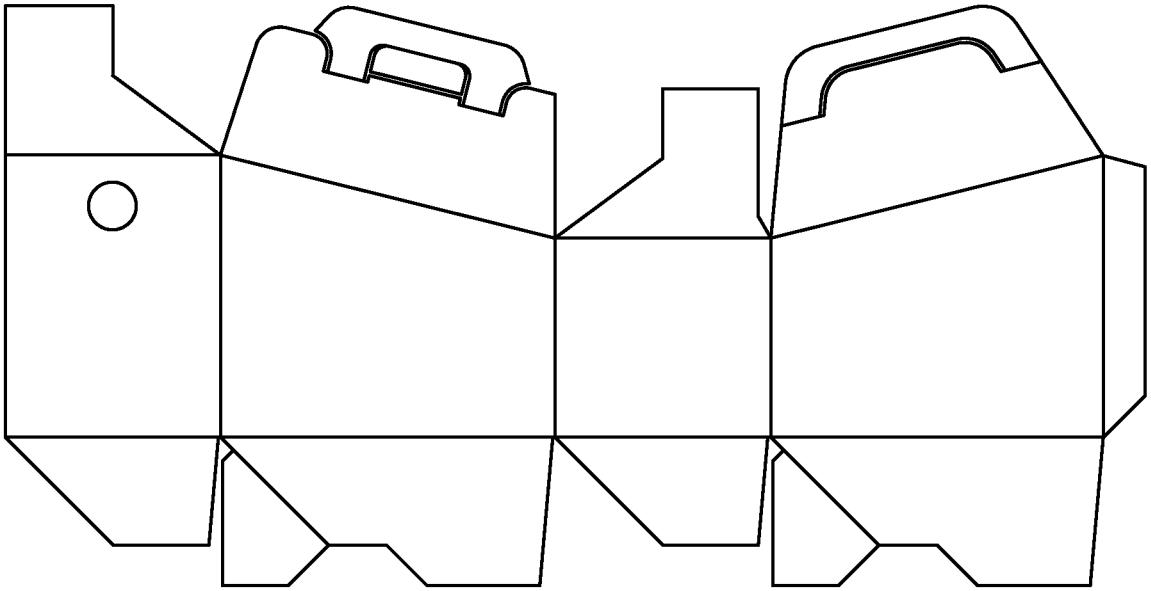

FIGS. 2A-2F are diagrams illustrating plan views of embodiments of blanks 200*a*, 200*b*, 200*c*, 200*d*, 200*e*, 200*f* used for making containers. The blanks 200*a*, 200*b*, 200*c*, 200*d*, 200*e*, 200*f* shown in FIGS. 2A-2F are alternative configurations to the blank 100 shown in FIG. 1A. For example, the blank 200*a* shown in FIG. 2A combines the blank 100 shown in FIG. 1A with a 1-2-3 bottom feature. In addition, the blanks 200*b*, 200*c* shown in FIGS. 2B and 2C combine the blank 100 shown in FIG. 1A with two different auto-bottom features. Furthermore, the first primary panel and the second primary panel of blank 200*d* shown in FIG. 2D are not inclined and have a uniform height. Yet further, the blank 200*e* shown in FIG. 2E is a mirror image of blank 200*b* shown in FIG. 2B. Yet further, the top flaps of blank 200*f* shown in FIG. 2F represent an alternative permutation of the top flaps of blank 200*e* shown in FIG. 2E.

With reference to FIGS. 1A-2F, embodiments are directed to a blank 100 used for making a container. The blank 100 comprises a first primary panel 101, a second primary panel 111, and a secondary panel 107, 117 (either 107 or 117). The first primary panel 101 is hingedly coupled to a first primary flap 102. The second primary panel 111 is hingedly coupled to a second primary flap 112. The secondary panel 107, 117 is hingedly coupled to a secondary flap 108, 118. The first primary flap 102 comprises a main portion 103 and a tip portion 104. The main portion 103 is hingedly coupled to a first handle 105. The tip portion 104 is positioned between the main portion 103 and the first handle 105 (e.g., FIG. 1A). The first primary panel 101 and the second primary panel 111 are configured to face each other when the container is in a box configuration (e.g., FIG. 1D). The second primary flap 112 is configured to fold towards the second primary panel 111 (e.g., FIG. 1D). The secondary flap 108, 118 is configured to fold towards the secondary panel 107, 117 (e.g., FIG. 1E). The first primary flap 102 is configured to fold towards the first primary panel 101 (e.g., FIG. 1F). The secondary flap 108, 118 is configured to be positioned between the second primary flap 112 and the main portion 103 when the container is in the box configuration. The tip portion 104 is configured to be positioned between the second primary flap 112 and an interior space of the container when the container is in the box configuration (e.g., FIGS. 1I and 1J). For example, when the second primary flap 112 is on the top of the container (e.g., FIGS. 1I), the tip portion 104 (not visible in FIG. 1I) is positioned below the second primary flap 112. The first handle 105 is configured to fold towards the main portion 103 (e.g., FIG. 1F). The container is configured to be held via the first handle 105 when the container is in the box configuration (e.g., FIG. 1I). The container may be held via the first handle 105 for a variety of purposes such as lifting, carrying, moving, pouring, serving, using, delivering, catering, storing, transporting, etc.

In an embodiment, the first primary flap 102, the second primary flap 112, and the secondary flap 108, 118 are configured to interlock with each other when the container is in the box configuration (e.g., FIG. 1J). The first primary flap 102, the second primary flap 112, and the secondary flap 108, 118 may be referred to as "interlocking flaps".

In an embodiment, the tip portion 104 is configured to be inserted in an aperture 110 provided by the second primary flap 112 and the secondary flap 108, 118 when the container is in the box configuration (e.g., FIGS. 1G and 1H).

In an embodiment, a gap between the first handle 105 and the first primary flap 102 is formed when the first handle 105 folds towards the main portion 103, allowing the container to be held via the first handle 105 when the container is in the box configuration (e.g., FIGS. 1F and 1I). The tip portion 104 and the gap between the first handle 105 and the first primary flap 102 may have a similar shape.

In an embodiment, the second primary flap 112 comprises two extensions 114. The second primary flap 112 is hingedly coupled to a second handle 115 between the two extensions 114 (e.g., FIG. 1A). The second handle 115 is configured to fold towards the second primary flap 112 (e.g., FIGS. 1D and 1E). The container is configured to be held via the second handle 115 when the container is in the box configuration (e.g., FIG. 1I). The container may be held via the second handle 115 for a variety of purposes such as lifting, carrying, moving, pouring, serving, using, delivering, catering, storing, transporting, etc.

In an embodiment, the second handle 115 is removably connected to the two extensions 114. The second handle 115 is configured to disconnect from the two extensions 114. The second handle 115 may disconnect from the two extensions 114 prior to the secondary flap 108, 118 folding towards the secondary panel 107, 117 (e.g., FIG. 1D). Moreover, the second handle 115 may be required to fold towards the second primary flap 112 prior to the secondary flap 108, 118 folding towards the secondary panel 107, 117 (e.g., FIG. 1D).

In an embodiment, the second handle 115 is hingedly coupled to a reinforcement portion 116 (e.g., FIG. 1A). The first handle 105 is configured to be positioned between the second handle 115 and the reinforcement portion 116 when the container is in the box configuration (e.g., FIG. 1I).

In an embodiment, the second primary flap 112 is hingedly coupled to a second handle 115. The second handle 115 is configured to fold towards the second primary flap 112. The second primary flap 112 is configured to be positioned between the tip portion 104 and the second handle 115 when the container is in the box configuration (e.g., FIGS. 1I and 1J).

In an embodiment, the second primary flap 112 comprises two extensions 114 (e.g., FIG. 1A). The tip portion 104 is configured to be inserted between the two extensions 114 when the container is in the box configuration (e.g., FIGS. 1H and 1J).

In an embodiment, the first handle 105 is removably connected to the tip portion 104 (e.g., FIG. 1A). The first handle 105 is configured to disconnect from the tip portion 104 (e.g., FIG. 1F). The first handle 105 may disconnect from the tip portion 104 prior to the first primary flap 102, the second primary flap 112, and the secondary flap 108, 118 interlocking with each other when the container is in the box configuration (e.g., FIG. 1G). Moreover, the first handle 105 may fold towards the main portion 103 prior to the first primary flap 102, the second primary flap 112, and the secondary flap 108, 118 interlocking with each other when the container is in the box configuration (e.g., FIG. 1G).

In an embodiment, the first primary panel 101 is hingedly coupled to the secondary panel 107, 117. The first primary panel 101 is configured to fold towards the secondary panel 117 when the container is moved from a flat configuration (e.g., FIG. 1B) to the box configuration (e.g., FIG. 1G). Alternatively, in an embodiment, the first primary panel 101 is configured to fold away from the secondary panel 107 when the container is moved from the flat configuration (e.g., FIG. 1B) to the box configuration (e.g., FIG. 1F).

With reference to FIGS. 1B-1J, embodiments are directed to a container. The container comprises a first primary panel 101, a second primary panel 111, and a secondary panel 107, 117 (either 107 or 117). The first primary panel 101 is hingedly coupled to a first primary flap 102. The second primary panel 111 is hingedly coupled to a second primary flap 112. The secondary panel 107, 117 is hingedly coupled to a secondary flap 108, 118. The first primary flap 102 comprises a main portion 103 and a tip portion 104. The main portion 103 is hingedly coupled to a first handle 105. The tip portion 104 is positioned between the main portion 103 and the first handle 105 when the container is in a flat configuration (e.g., FIG. 1B). The first primary panel 101 and the second primary panel 111 are configured to face each other when the container is in a box configuration (e.g., FIG. 1D). The second primary flap 112 is configured to fold towards the second primary panel 111 (e.g., FIG. 1D). The secondary flap 108, 118 is configured to fold towards the secondary panel 107, 117 (e.g., FIG. 1E). The first primary flap 102 is configured to fold towards the first primary panel 101 (e.g., FIG. 1F). The secondary flap 108, 118 is configured to be positioned between the second primary flap 112 and the main portion 103 when the container is in the box configuration. The tip portion 104 is configured to be positioned between the second primary flap 112 and an interior space of the container when the container is in the box configuration (e.g., FIGS. 1I and 1J). For example, when the second primary flap 112 is on the top of the container (e.g., FIGS. 1I), the tip portion 104 (not visible in FIG. 1I) is positioned below the second primary flap 112. The first handle 105 is configured to fold towards the main portion 103 (e.g., FIG. 1F). The container is configured to be held via the first handle 105 when the container is in the box configuration (e.g., FIG. 1I). The container may be held via the first handle 105 for a variety of purposes such as lifting, carrying, moving, pouring, serving, using, delivering, catering, storing, transporting, etc.

It is noted that FIGS. 1B-1J may be referenced with regards to an embodiment of a method to assemble and/or construct the container.

First, the container is erected from a flat configuration (FIG. 1B) to a box configuration (FIG. 1C), and typically folding and/or forming the bottom flap(s) in an appropriate manner.

Second, as shown in FIG. 1D, the second primary flap 112 is folded forward while the second handle 115 is folded in reverse.

Third, as shown in FIG. 1E, the secondary flap 108, 118 is folded onto the second primary flap 112.

Fourth, as shown in FIG. 1F, the first primary flap 102 is folded. As shown in FIG. 1G, to enable the interlocking mechanism, the first primary flap 102 may be pushed down until the tip portion 104 is inserted in an aperture 110 provided by the second primary flap 112 and the secondary flap 108, 118. As the tip portion 104 is inserted in the aperture 110, the first handle 105 is folded up (in reverse).

Fifth, as shown in FIG. 1I, the top of the container is formed by pulling up the first handle 105 and/or the second handle 115. The first primary flap 102, the second primary flap 112, and the secondary flap 108, 118 all interlock with each other (FIGS. 1I and 1J). The container may be held using the first handle 105 and/or the second handle 115.

Although embodiments are described above with reference to a blank used for making a container, wherein the first primary panel and the second primary panel are shown having an inclination, the first primary panel and the second primary panel described in any of the above embodiments may be configured to accommodate different applications. For example, as shown in FIG. 2D, the first primary panel and the second primary panel may have a uniform height. Such alternatives are considered to be within the spirit and scope of the present invention, and may therefore utilize the advantages of the configurations and embodiments described above.

In addition, although embodiments are described above with reference to a blank used for making a container, wherein the first primary flap, the second primary flap, and the secondary flap are shown interlocking with each other to form a top of the container, the first primary flap, the second primary flap, and the secondary flap described in any of the above embodiments may alternatively interlock with each other to form a side of the container or a bottom of the container. Such alternatives are considered to be within the spirit and scope of the present invention, and may therefore utilize the advantages of the configurations and embodiments described above.

Further, although embodiments are described above with reference to a blank used for making a container, wherein the first primary panel and the secondary panel are shown perpendicular with each other when the container is in the box configuration, the first primary panel and the secondary panel described in any of the above embodiments may alternatively be at an acute angle with each other or at an obtuse angle with each other when the container is in the box configuration. Portions or all of the blank may be configured to accommodate such alternatives. Such alternatives are considered to be within the spirit and scope of the present invention, and may therefore utilize the advantages of the configurations and embodiments described above.

Yet further, although embodiments are described above with reference to a blank used for making a container, wherein the blank is shown with uniform portions (e.g., with uniform thickness), portions or all of the blank described in any of the above embodiments may alternatively be non-uniform (e.g., having varying thickness, discontinuities such as holes, slits, grooves, ridges, slits, a combination thereof, etc.). Such alternatives are considered to be within the spirit and scope of the present invention, and may therefore utilize the advantages of the configurations and embodiments described above.

Yet further, the embodiments described above may comprise a spout aperture 119 (e.g., circular aperture positioned on the secondary panel 107 as shown in FIG. 1A for example), wherein the spout aperture is configured to allow a spout of an inner bag to protrude out of the container so that the material in the inner bag can flow out of the container via the spout (e.g., bag-in-box application). Moreover, the embodiments described above may comprise a spout reinforcement portion, wherein the spout reinforcement portion is configured to slide and/or fit around the spout of an inner bag when the container is in the box configuration. For example, the spout reinforcement portion may be removably connected to the secondary flap 118. In such case, the spout reinforcement portion would be configured to be disconnected from the secondary flap 118 when the container is in the box configuration. While the spout aperture 119 is illustrated as having a circular configuration, any other configurations capable of allowing a spout from an inner bag to protrude from the container as described above are envisioned, including square or irregularly shaped apertures.

The method steps in any of the embodiments described herein are not restricted to being performed in any particular order. Also, structures mentioned in any of the method embodiments may utilize structures mentioned in any of the device embodiments. Such structures may be described in detail with respect to the device embodiments only but are applicable to any of the method embodiments.

Features in any of the embodiments described in this disclosure may be employed in combination with features in other embodiments described herein, such combinations are considered to be within the spirit and scope of the present invention.

The contemplated modifications and variations specifically mentioned in this disclosure are considered to be within the spirit and scope of the present invention.

More generally, even though the present disclosure and exemplary embodiments are described above with reference to the examples according to the accompanying drawings, it is to be understood that they are not restricted thereto. Rather, it is apparent to those skilled in the art that the disclosed embodiments can be modified in many ways without departing from the scope of the disclosure herein. Moreover, the terms and descriptions used herein are set forth by way of illustration only and are not meant as limitations. Those skilled in the art will recognize that many variations are possible within the spirit and scope of the disclosure as defined in the following claims, and their equivalents, in which all terms are to be understood in their broadest possible sense unless otherwise indicated.

For the figures referred to herein, a summary of the reference numbers used in the figures is included in Table 1, below.

TABLE 1

Reference Index for Drawings

| Description | FIGS. 1A-1J | FIGS. 2A-2F |
|---|---|---|
| Blank | 100 | 200a, 200b, 200c, 200d, 200e, 200f |
| First primary panel | 101 | |
| Second primary panel | 111 | |
| Secondary panel | 107 or 117 | |
| First primary flap | 102 | |
| Main portion | 103 | |
| Tip portion | 104 | |
| First handle | 105 | |
| Second primary flap | 112 | |
| Two extensions | 114 | |
| Secondary flap | 108 or 118 | |
| Aperture | 110 | |
| Second handle | 115 | |
| Reinforcement portion | 116 | |
| Glue flap | 109 | |
| Spout aperture | 119 | |
| Flat configuration | When the container is not erected; see FIG. 1B for example | |
| Box configuration | When the container is erected; see FIGS. 1C, 1G, and 1I for example | |

Those skilled in the art will recognize or be able to ascertain using no more than routine experimentation, many equivalents to the specific embodiments of the invention described herein. Such equivalents are intended to be encompassed by the following claims.

What is claimed is:

1. A blank used for making a container, the blank comprising:

a first primary panel;

a second primary panel;

a secondary panel;

wherein the first primary panel is hingedly coupled to a first primary flap, wherein the second primary panel is hingedly coupled to a second primary flap, and wherein the secondary panel is hingedly coupled to a secondary flap;

wherein the first primary flap comprises a main portion and a tip portion, wherein the main portion is hingedly coupled to a first handle, and wherein the tip portion is positioned between the main portion and the first handle;

wherein the first primary panel and the second primary panel are configured to face each other when the container is in a box configuration;

wherein the secondary flap is configured to be positioned between the second primary flap and the main portion when the container is in the box configuration, wherein the first primary flap, the main portion, the second primary flap, and the secondary flap are configured to be substantially planar with each other when the container is in the box configuration, and wherein the tip portion is configured to be positioned between the second primary flap and an interior space of the container when the container is in the box configuration; and wherein the first handle is configured to fold towards the main portion, and wherein the first handle and the main portion are configured to be not planar with each other when the container is in the box configuration.

2. The blank of claim 1, wherein the first primary flap, the second primary flap, and the secondary flap are configured to interlock with each other when the container is in the box configuration.

3. The blank of claim 1, wherein the tip portion is configured to be inserted in an aperture provided by the second primary flap and the secondary flap when the container is in the box configuration.

4. The blank of claim 1, wherein a gap between the first handle and the first primary flap is formed when the first handle folds towards the main portion, allowing the container to be held via the first handle when the container is in the box configuration.

5. The blank of claim 1, wherein the second primary flap comprises two extensions, wherein the second primary flap is hingedly coupled to a second handle between the two extensions, wherein the second handle is configured to fold towards the second primary flap, and wherein the container is configured to be held via the second handle when the container is in the box configuration.

6. The blank of claim 1, wherein the second primary flap comprises two extensions, and wherein the tip portion is configured to be inserted between the two extensions when the container is in the box configuration.

7. The blank of claim 1, wherein the first handle is removably connected to the tip portion, and wherein the first handle is configured to disconnect from the tip portion.

8. The blank of claim 1, wherein the first primary panel is hingedly coupled to the secondary panel, and wherein the first primary panel is configured to fold towards or to fold away from the secondary panel when the container is moved from a flat configuration to the box configuration.

9. A container, the container comprising:

a first primary panel;

a second primary panel;

a secondary panel;

wherein the first primary panel is hingedly coupled to a first primary flap, wherein the second primary panel is hingedly coupled to a second primary flap, and wherein the secondary panel is hingedly coupled to a secondary flap;

wherein the first primary flap comprises a main portion and a tip portion, wherein the main portion is hingedly coupled to a first handle, and wherein the tip portion is positioned between the main portion and the first handle when the container is in a flat configuration;

wherein the first primary panel and the second primary panel are configured to face each other when the container is in a box configuration;

wherein the secondary flap is configured to be positioned between the second primary flap and the main portion when the container is in the box configuration, wherein the first primary flap, the main portion, the second primary flap, and the secondary flap are configured to be substantially planar with each other when the container is in the box configuration, and wherein the tip portion is configured to be positioned between the second primary flap and an interior space of the container when the container is in the box configuration; and wherein the first handle is configured to fold towards the main portion, and wherein the first handle and the main portion are configured to be not planar with each other when the container is in the box configuration.

10. A blank used for making a container, the blank comprising: a first primary panel; a second primary panel; a secondary panel; wherein the first primary panel is hingedly coupled to a first primary flap, wherein the second primary panel is hingedly coupled to a second primary flap, and wherein the secondary panel is hingedly coupled to a secondary flap; wherein the first primary flap comprises a main portion and a tip portion, and wherein an end of the second primary flap is hingedly coupled to a second handle; wherein the first primary panel and the second primary panel are configured to face each other when the container is in a box configuration; wherein the secondary flap is configured to be positioned between the second primary flap and the main portion when the container is in the box configuration, wherein the first primary flap, the main portion, the second primary flap, and the secondary flap are configured to be substantially planar with each other when the container is in the box configuration, and wherein the tip portion is configured to be positioned between the second primary flap and an interior space of the container when the container is in the box configuration; and wherein the second handle is configured to fold towards the second primary flap, and wherein the second handle and the second primary flap are configured to be not planar with each other when the container is in the box configuration.

11. A container, the container comprising: a first primary panel; a second primary panel; a secondary panel; wherein the first primary panel is hingedly coupled to a first primary flap, wherein the second primary panel is hingedly coupled to a second primary flap, and wherein the secondary panel is hingedly coupled to a secondary flap; wherein the first primary flap comprises a main portion and a tip portion, and wherein an end of the second primary flap is hingedly coupled to a second handle; wherein the first primary panel and the second primary panel are configured to face each other when the container is in a box configuration; wherein the secondary flap is configured to be positioned between the second primary flap and the main portion when the container is in the box configuration, wherein the first primary flap, the main portion, the second primary flap, and the secondary flap are configured to be substantially planar with each other when the container is in the box configuration, and wherein the tip portion is configured to be positioned between the second primary flap and an interior space of the container when the container is in the box configuration; and wherein the second handle is configured to fold towards the second primary flap, and wherein the second handle and the second primary flap are configured to be not planar with each other when the container is in the box configuration.

* * * * *